US011670858B2

(12) United States Patent
Sazegar et al.

(10) Patent No.: US 11,670,858 B2
(45) Date of Patent: Jun. 6, 2023

(54) NON-CIRCULAR CENTER-FED ANTENNA AND METHOD FOR USING THE SAME

(71) Applicant: Kymeta Corporation, Redmond, WA (US)

(72) Inventors: Mohsen Sazegar, Kirkland, WA (US); Chris Eylander, Redmond, WA (US)

(73) Assignee: KYMETA CORPORATION, Redmond, WA (US)

( * ) Notice: Subject to any disclaimer, the term of this patent is extended or adjusted under 35 U.S.C. 154(b) by 0 days.

(21) Appl. No.: 17/544,739

(22) Filed: Dec. 7, 2021

(65) Prior Publication Data

US 2022/0239000 A1 Jul. 28, 2022

Related U.S. Application Data

(63) Continuation of application No. 16/844,955, filed on Apr. 9, 2020, now Pat. No. 11,258,176.

(60) Provisional application No. 62/833,508, filed on Apr. 12, 2019.

(51) Int. Cl.

| | |
|---|---|
| ***H01Q 9/04*** | (2006.01) |
| ***H01Q 21/06*** | (2006.01) |
| ***H01Q 13/10*** | (2006.01) |
| ***H01Q 21/00*** | (2006.01) |
| ***H01Q 19/06*** | (2006.01) |
| ***H01Q 15/00*** | (2006.01) |

(52) U.S. Cl.

CPC ..... *H01Q 9/045* (2013.01); *H01Q 13/103* (2013.01); *H01Q 15/0086* (2013.01); *H01Q 19/067* (2013.01); *H01Q 21/0056* (2013.01); *H01Q 21/065* (2013.01)

(58) Field of Classification Search

CPC .... H01Q 9/045; H01Q 13/103; H01Q 13/106; H01Q 21/0056; H01Q 19/067; H01Q 21/065; H01Q 15/0086; H01Q 21/0012; H01Q 9/0442

See application file for complete search history.

(56) References Cited

U.S. PATENT DOCUMENTS 9,887,456 B2 * 2/2018 Bily ..... H01Q 3/34
10,811,784 B2 * 10/2020 Sikes ..... H01Q 1/48

* cited by examiner

*Primary Examiner* — Vibol Tan
(74) *Attorney, Agent, or Firm* — Womble Bond Dickinson (US) LLP

(57) ABSTRACT

A non-circular center-fed antenna and method for using the same are disclosed. In one embodiment, the antenna comprises: a non-circular antenna aperture with radio-frequency (RF) radiating antenna elements; and a non-radially symmetric directional coupler to supply a RF feed wave to the aperture at a central location within the antenna aperture to enable the feed wave to propagate outward from the central location to an edge of the aperture.

20 Claims, 20 Drawing Sheets

CIRCULAR DISCRETIZATION OF THE COUPLER DESIGN

CIRCULAR INTERPOLATION OF THE COUPLER DESIGN

Iris L2

Iris L1

Patch and Iris L1

Top View

NON-CIRCULAR CENTER-FED ANTENNA AND METHOD FOR USING THE SAME

PRIORITY

The present application is a continuation of and claims the benefit of U.S. Non-Provisional application Ser. No. 16/844,955, filed on Apr. 9, 2020 and entitled "Non-Circular Center-fed Antenna and Method of Using the Same" and U.S. Provisional Patent Application No. 62/833,508, filed on Apr. 12, 2019 and entitled "Non-Circular Center-fed Antenna and Method of Using the Same", and is incorporated by reference in its entirety.

FIELD OF THE INVENTION

Embodiments of the present invention relate to the field of antennas; more particularly, embodiments of the present invention relate to non-circular, center-fed antennas.

BACKGROUND OF THE INVENTION

Some existing antenna designs rely on radial waveguide mode in which a feed wave is reflected from edges of an antenna aperture to the center of the aperture. These antennas have an edge-fed architecture. The wave is reflected so that it travels towards the center to create better conditions for realizing a flat aperture distribution.

Two prior art papers, Ando et al., "Radial line slot antenna for 12 GHz DBS satellite reception", and Yuan et al., "Design and Experiments of a Novel Radial Line Slot Antenna for High-Power Microwave Applications", discuss various antennas. The limitation of the antennas described in both these papers is that the beam is formed at only one static angle. The feed structures described in the papers are folded, dual layer, where the first layer accepts the pin feed and guides the electromagnetic wave outward to the edges, bends the wave up to the top layer and the top layer then guides it from the periphery to the center exciting fixed slots along the way. The slots are typically oriented in orthogonal pairs, giving a fixed circular polarization on transmit and the opposite in receive mode. Finally, an absorber terminates whatever power remains.

Because the mode of the edge-fed antennas is radially symmetric, the reflecting structure is radially symmetric, thereby locking the aperture shape to a circle. However, requiring the use of a circular antenna may limit the size of the antenna and not utilize a good portion of available space when the available space is not circularly shaped (e.g., rectangularly-shaped).

SUMMARY OF THE INVENTION

A non-circular center-fed antenna and method for using the same are disclosed. In one embodiment, the antenna comprises: a non-circular antenna aperture with radio-frequency (RF) radiating antenna elements; and a non-radially symmetric directional coupler to supply a RF feed wave to the aperture at a central location within the antenna aperture to enable the feed wave to propagate outward from the central location to an edge of the aperture.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Overview

Non-circular, center-fed antennas and methods for creating and using the same are disclosed. In one embodiment, the non-circular, center-fed antennas comprise holographic antennas that have a non-circular shape. In one embodiment, the holographic antennas comprise holographic metasurface antennas. The holographic metasurface antennas may have surface scattering metamaterial antenna elements. Examples of such antenna elements are described in further detail below. Note that the present invention and techniques disclosed herein are not limited to using the antenna elements and/or apertures disclosed herein and may be applicable to many different antenna architectures and implementations.

Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using certain frequencies (e.g., Ka-band frequencies, Ku-band frequencies, etc.) for civil commercial satellite communications. Note that embodiments of the antenna system also can be used in earth stations that are not on mobile platforms (e.g., fixed or transportable earth stations). In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas). In one embodiment, the antenna system comprises three functional subsystems: (1) a wave propagating structure consisting of a wave feed architecture; (2) an array of wave scattering metamaterial antenna elements (e.g., unit cells); and (3) a control structure to command formation of an adjustable radiation field (beam) from the metamaterial scattering elements using holographic principles.

Figure 15:
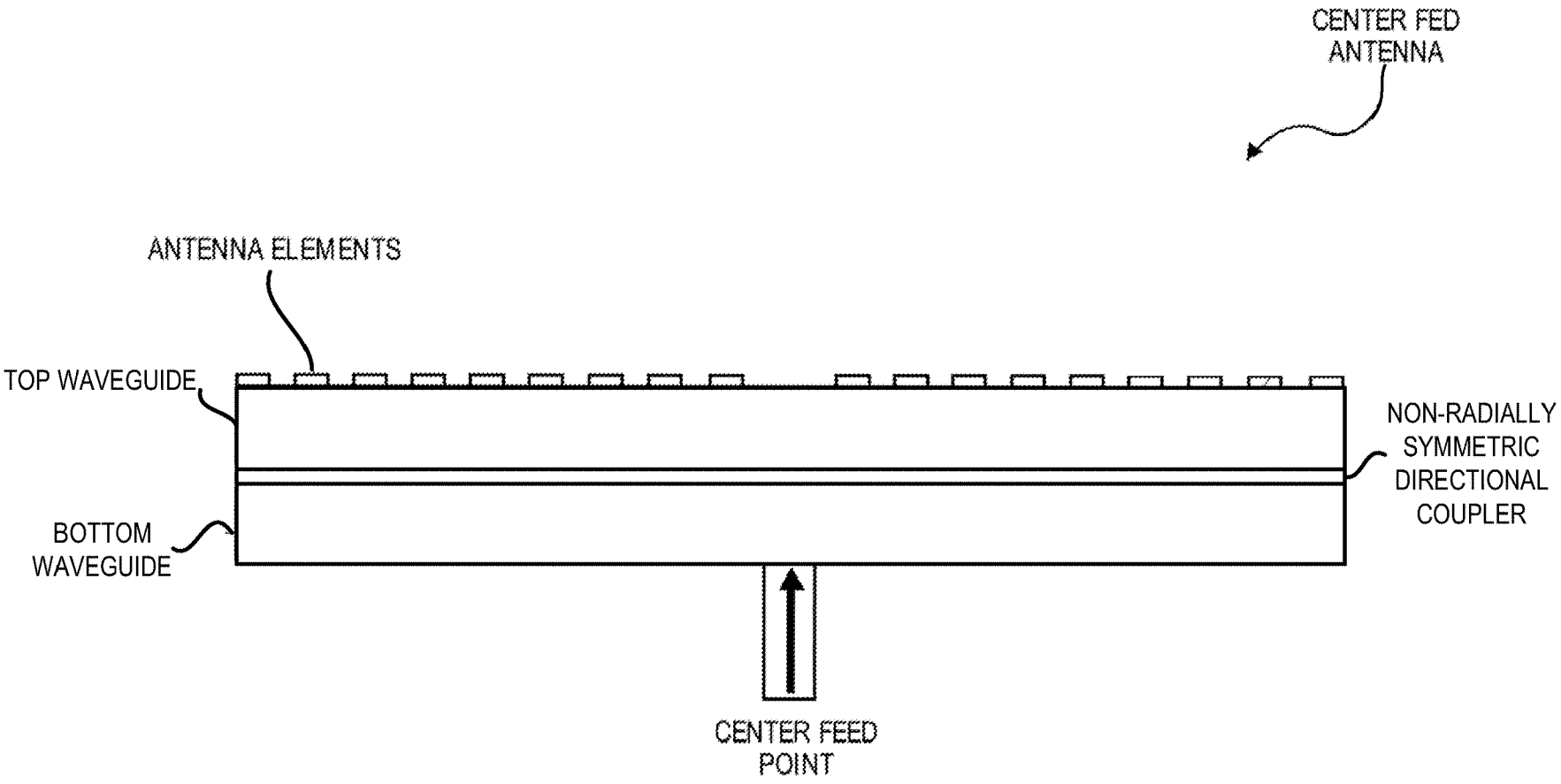
FIG. 15 illustrates a block diagram of a non-circular, center-fed antenna with a non-radially symmetric directional coupler.

In non-circular, center-fed antenna embodiments described herein, a directional coupler coupling power from the bottom waveguide to the top waveguide feeds the aperture from the center outward toward the edge of the aperture, as shown in FIG. 15. In contrast, in the case of edge-fed antennas, the feed structure requires a circular shape since the shape of the waveguide determines the phase of the propagating wave. The prior art uses a radial symmetric directional coupler for feeding a circular aperture, maintaining a uniform illumination across the aperture. Embodiments of the invention disclosed herein include the use of a non-radial-symmetric directional coupler that allows feeding an aperture that has a non-circular shape (e.g., rectangle shape, square shape, hexagon shape, octagon shape, triangular shape, elliptical shape, etc.), while maintaining a uniform aperture illumination. When an antenna aperture uses a center-fed architecture, the wave is not reflected and therefore the shape no longer has to be a circle. Furthermore, the power can be transferred to the form factor in a manner that is not radially symmetric by spatially modifying the directional coupler coupling coefficients, which takes further advantage of the non-circular shape. A rectangular shape can yield a perfectly flat aperture distribution if desired, although there is a fundamental tradeoff between power accepted and aperture efficiency.

The use of non-circular antennas is advantageous because different applications have different form factors, and when the aperture size can match the form factor, this increases the antenna performance by increasing antenna gain and the directivity. In contrast, using circular antennas does not fill the available space and leads to lower antenna gain. Thus, embodiments of the invention are helpful in cases where the available space for an antenna is non-circular and can result in antennas that fill the available space and have better performance.

These techniques also allow creation of different super architectures from sub-architectures. For purposes herein, this is referred to as tiling. The capability to tile allows for more design freedom and opens up new antenna functionality and enhancement of existing key performance indicators (KPIs). In one embodiment, the antenna aperture comprises a plurality of sub-apertures that tile the available space for an antenna aperture or tile more of the available space than a circular, edge-fed antenna would cover. Embodiments of the invention allow tiling an antenna aperture with multiple separate apertures without impacting the surface utilization or creating large gaps between the segments. Note that in one embodiment, the tiling approach enabled through this concept provides a way to reduce the maximum path length in the waveguide and results in an increase of the instantaneous bandwidth.

Figure 1A:
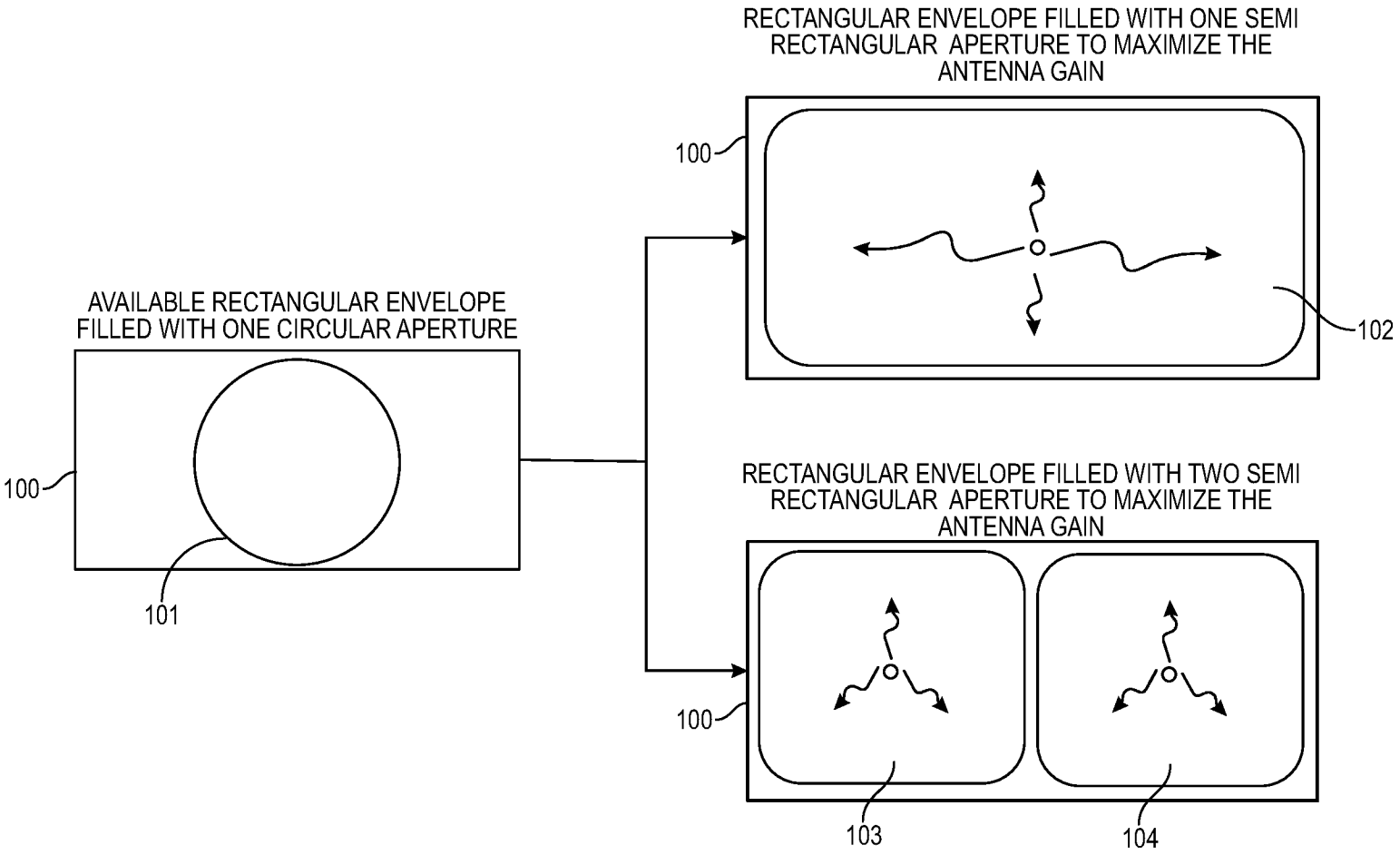
FIGS. 1A-1C illustrate examples of maximizing surface utilization for non-circular antenna apertures.
Figure 1B:
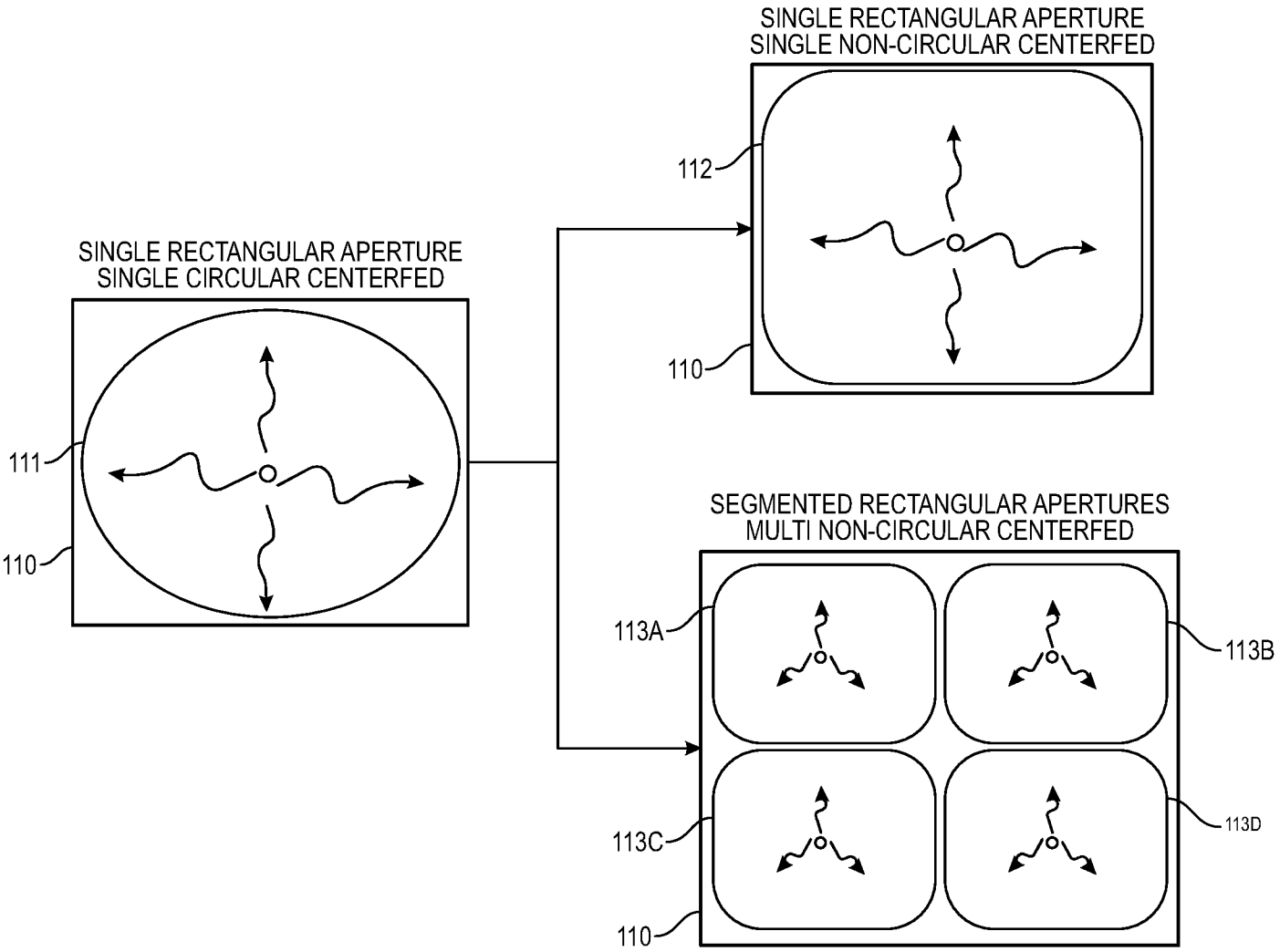
Figure 1C:
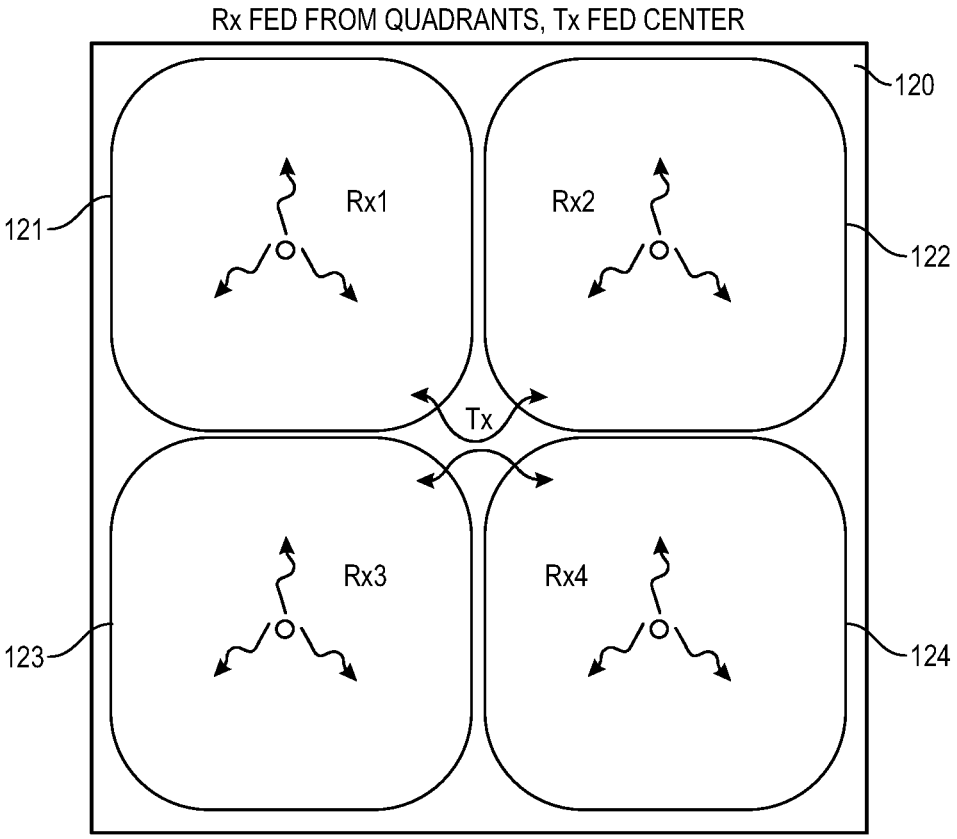

FIGS. 1A-1C illustrate examples of antenna apertures increasing, and potentially maximizing, the surface utilization for a rectangular envelope using one or multiple rectangular antenna apertures.

Referring to FIG. 1A, an envelope 100 is filled one circular aperture 101. The rectangular envelope 100 can be filled with one semi-rectangular, center-fed antenna aperture 102 to increase, and potentially maximize, the antenna gain. Furthermore, rectangular envelope 100 can be filled with two semi-rectangular center-fed antenna sub-apertures 103 and 104 to maximize the antenna gain as well. In one embodiment, antenna sub-apertures 103 and 104 are fed with a feed wave using two different feeds. Thus, by filling the rectangular envelope 100 more fully with an antenna aperture, antenna gain may be improved.

FIG. 1B illustrates a similar surface utilization, except in this case the surface utilization is for a square envelope. Referring to FIG. 1B, the envelope 110 is filled is a single circular, center-fed aperture 111. Envelope 110 can be filled with a single rectangular aperture such as single non-circular, center-fed aperture 112 or may be filled with multiple non-circular, center-fed apertures such as the four sub-apertures (tiles) 113A-113D. In one embodiment, antenna apertures 113A-113D are individually fed with a separate feed wave using four different feeds.

FIG. 1C illustrates four rectangular, non-circular, center-fed sub-apertures (tiles) 121-124 in envelope 120. Apertures 121-124 are fed from separate quadrants (a separate feed for each when operating to receive signals from one or more satellites. In one embodiment, each separate sub-aperture transmits signals individually. In other embodiments, the sub-apertures receive (Rx) beams are fed from the center of the sub-apertures, while one transmit (Tx) beam is fed from the center of the feed global center. This may be accomplished by an Rx sub-element placement approach while the Tx elements are interleaved across the entire aperture.

Note that in the case of having multiple sub-apertures that fill an envelope, in one embodiment, there are absorbers or other form of feed wave termination between the sub-apertures to ensure that the feed wave of one of the sub-apertures does not cause interference with any adjacent sub-apertures. In another embodiment, such absorbers or feed wave terminations are not needed as the power level of the feed wave is selected so that it dissipates as it propagates from the center of its sub-aperture until its power level is such that it doesn't interfere with adjacent sub-apertures.

Furthermore, in one embodiment, when sub-apertures are being used for receiving signals, the received signals are RF coupled using waveguides in a manner well-known in the art, so that all the channels are coupled together and feed to one RF chain (e.g., diplexer, modem, etc.). In another embodiment, there is an RF chain for each sub-aperture and all the received signals are converted to an intermediate frequency (IF) and then the signals are combined at the IF in a manner well-known in the art.

Figure 2A:
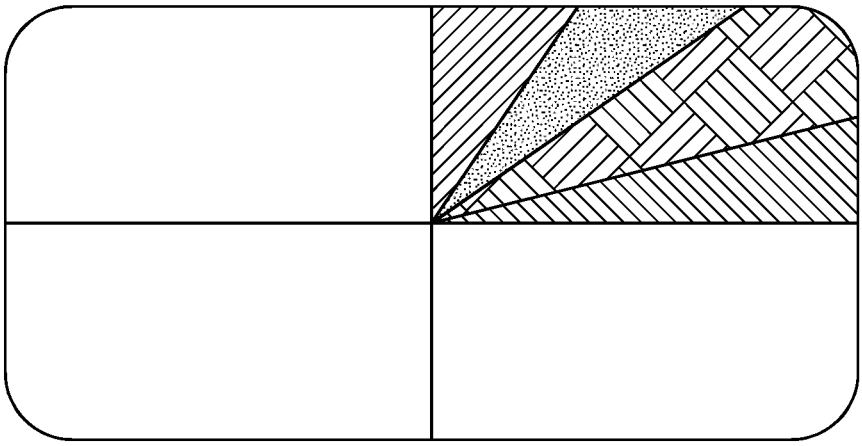
FIGS. 2A and 2B illustrate multiple ways for designing a coupler.
Figure 2B:
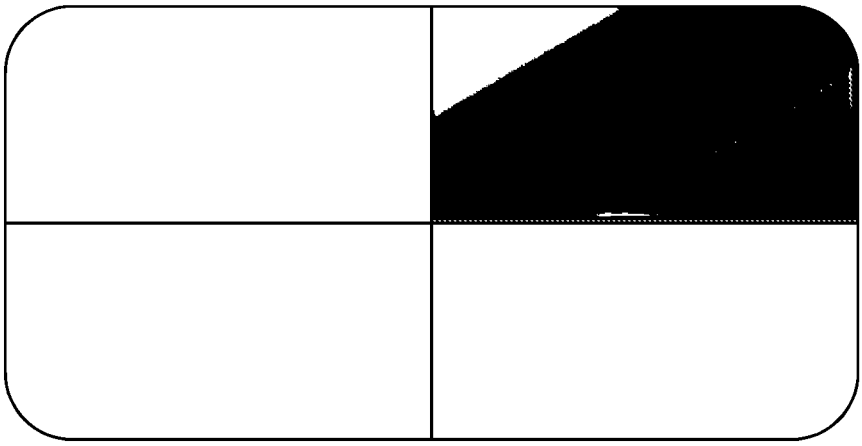

One goal for the coupler design is to reduce, and potentially minimize, the load power on each axis from the center of an antenna aperture to the edge of the aperture. FIGS. 2A and 2B illustrate two different ways for designing a coupler for a rectangular-shaped aperture where the coupler has coupling profiles that are different for the different axis.

Referring to FIG. 2A, there are three axes with different length at 0°, 45° and 90°. To achieve a low load loss on each axis, a different coupler profile for each axis is needed. The sections in between the axes can either be discretized into wedge sections or interpolated depending on the angle and path length.

More specifically, in FIG. 2A, a different coupler is designed for each quadrant or section of a non-circular aperture by dividing the quadrant/section into wedges for which the coupling is different. In FIG. 2A, there are four wedges shown in the upper right quadrant. Each of the wedges are associated with a different radial line for which a coupler design has been determined. The coupler design initially starts with identifying a predetermined number of radiuses and a coupler design is made for each the radiuses. This predetermined set of radiuses may include the shortest and longest radius in that section of the aperture. For those other radial lines for which a coupler design has not been determined, the coupling that is to be used is based on its radial line length and which of the radiuses in the predetermined set is closest to it in length. Based on this determination, the geographical part of the feed that is applied to the coupler design for that closest radius (in length) of the radius from the predetermined set is used for that radius. In one embodiment, this process continues to determine which of the coupler designs for predetermined radiuses is applied to each of the radial lines in that section of the aperture. In this manner, the coupling rate changes on different radial lines from the center feed because there is no radial symmetry.

For example, in one embodiment, for the longest path from the center feed to the edge of the aperture, the coupler is designed so that as the feed wave travels travel along that path, less coupling per length occurs than going along the shortest path between the center feed to the edge of the aperture. This is done to maintain the correct aperture distribution and load power. In one embodiment, the power transfer along each path is such that power is radiated at a faster rate along different paths. Thus, the coupler is designed so that coupling is different along different paths. In one embodiment, the coupling is such that the coupler is throttling back on longer paths in comparison to shorter paths (or not throttling back on shorter paths in comparison to longer paths).

Referring to FIG. 2B, the coupler design uses circular interpolation which applies predetermined coupler designs to other sections of a quadrant by using arcs between areas in which coupler designs have already been determined. The discretization used may be chosen in some cases by practical tolerance limitations associated with standard manufacturing techniques such as printed circuit board.

Figure 3:
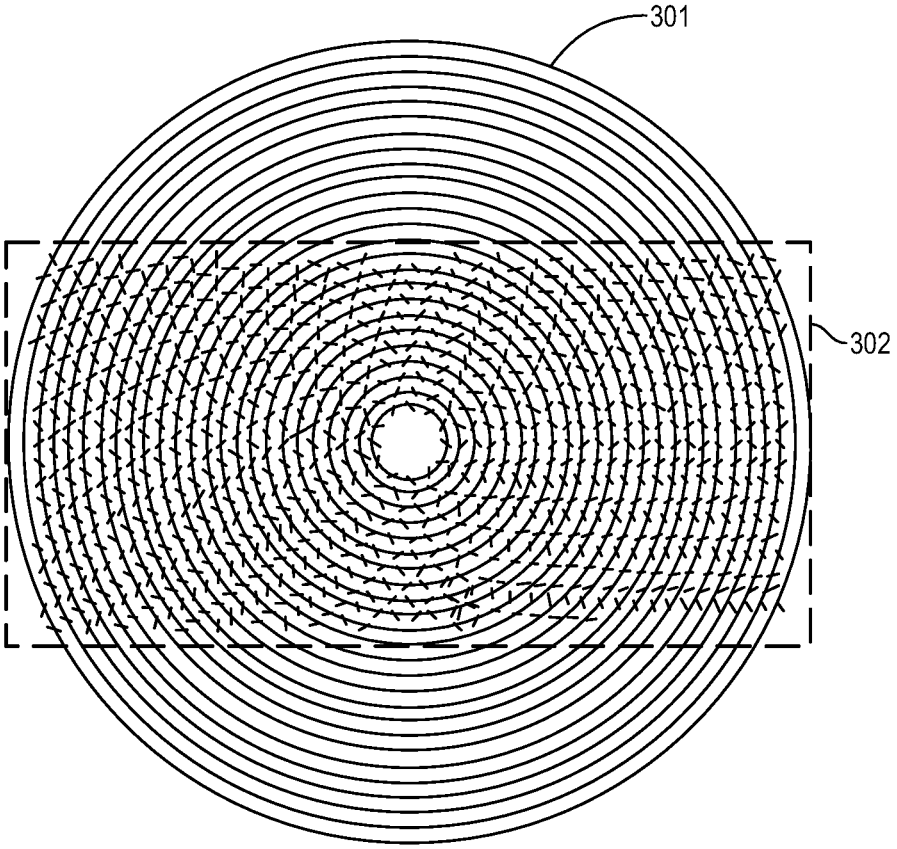
FIG. 3 illustrates an example of a placement of antenna elements in a rectangular aperture.

In one embodiment, the placement of antenna elements is not limited by the shape of the aperture or sub-aperture. For example, when the antenna elements are radio-frequency (RF) radiating antenna elements, such as for example, but not limited to, unit cells that are to be part of a rectangular aperture, the antenna elements may be placed on rings, spirals, rectangular grids or any other grid. FIG. 3 illustrates an example of a one embodiment of a ring-based placement of elements on rings in a rectangular aperture (i.e., for a rectangular envelope). Referring to FIG. 3, there are a number of placement rings 301 illustrated that are radially symmetric about a center of an antenna aperture that has a rectangular envelope 302. Note that the rings closer to the center of the aperture are complete rings while those that cross a border of the aperture at the edge of rectangular envelope 302 are only partial rings.

A rectangular aperture was used as a case study to construct a full wave simulation in High Frequency Structure Simulator (HFSS) to validate the center-fed rectangular aperture concept. One goal was to create an analytic modeling approach that demonstrated the trade space for non-circular apertures. A size of 14 inches×25 inches was used to create an HFSS full-wave simulation to compare and validate the analytic modeling framework.

Figure 4A:
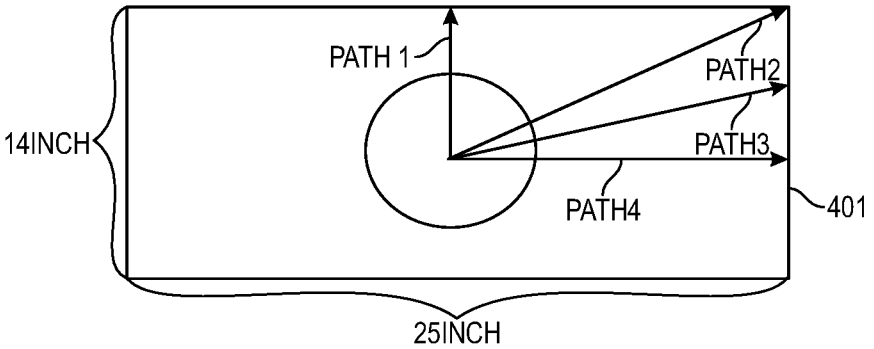
FIG. 4A-4I illustrate an example aperture and simulation results related to the example aperture.

FIG. 4A illustrates an example of a rectangularly-shaped antenna aperture. Referring to FIG. 4A, antenna aperture 401 has a form factor of 14 inches×25 inches. The minimum dimension from the center of aperture 401 is 7 inches, while the maximum dimension from the center of aperture 401 is 13.9 inches. The distance between 7 and 13.9 inches was discretized approximately by 0.4 inches. There were a total of 10 different coupler designs created. The goal for this design was to achieve high power transfer to the antenna. In order to maintain high power transfer along each radial path (e.g., paths 1-4), the power is radiated at a faster rate along different paths resulting in a different aperture distribution profile. Note that an alternative design could be realized focusing more on aperture distribution flatness at the expense of power transfer.

Figure 4B:
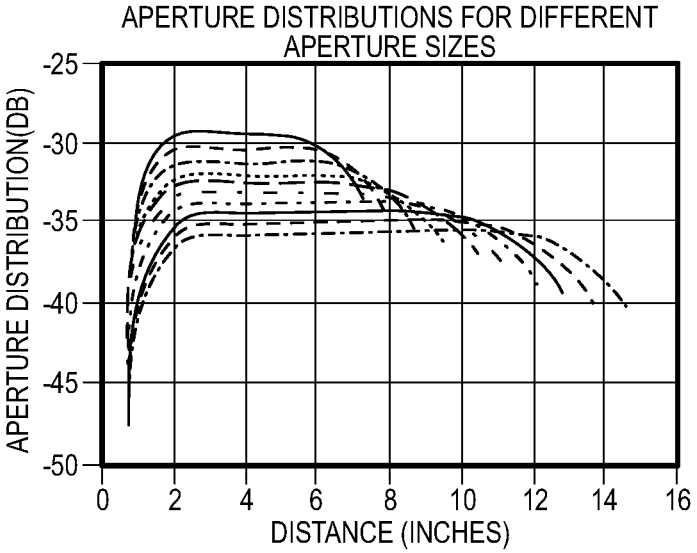
Figure 4C:
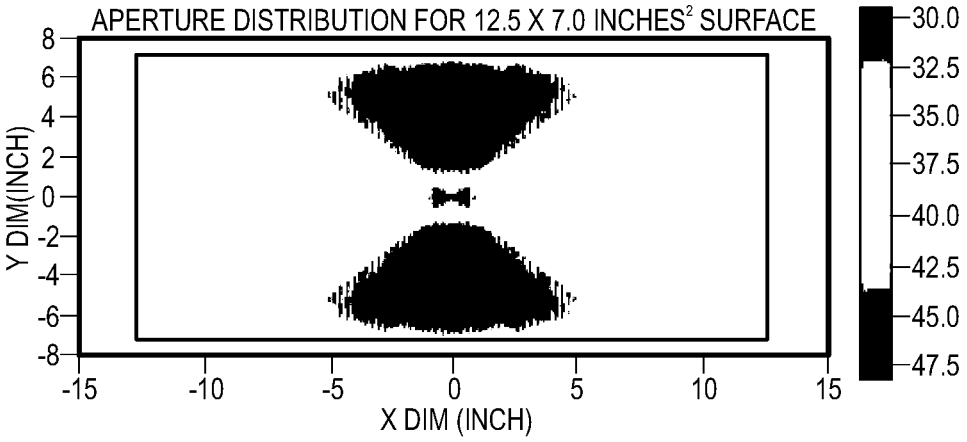

FIG. 4B illustrates that shorter lengths for a maximal power transfer design result in higher radiation in those regions. This is further illustrated in the heat map image shown in FIG. 4C. Note that the array taper efficiency for the rectangle aperture 401 is still relatively high ~0.35 dB in this example.

Figure 4D:
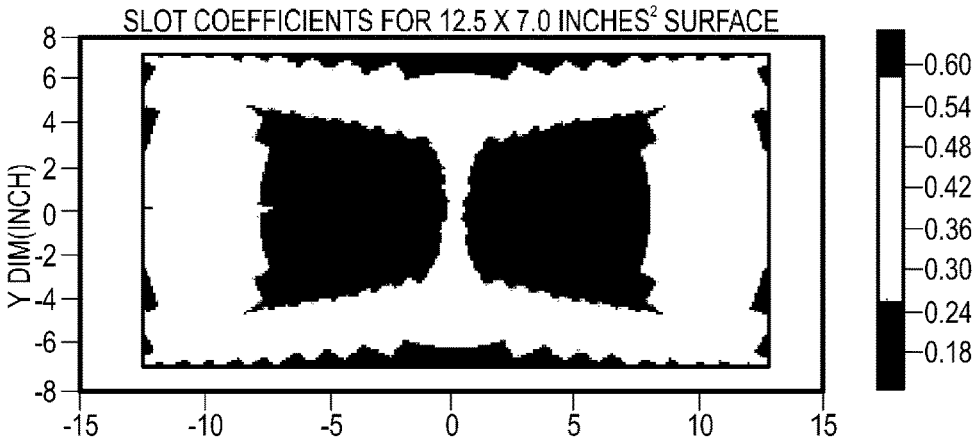

The coupling coefficients across the surface of the coupler can be visualized. There are 10 different radial coupler designs that are spatially discretized into the rectangular surface. This is illustrated in FIG. 4D.

Figure 4E:
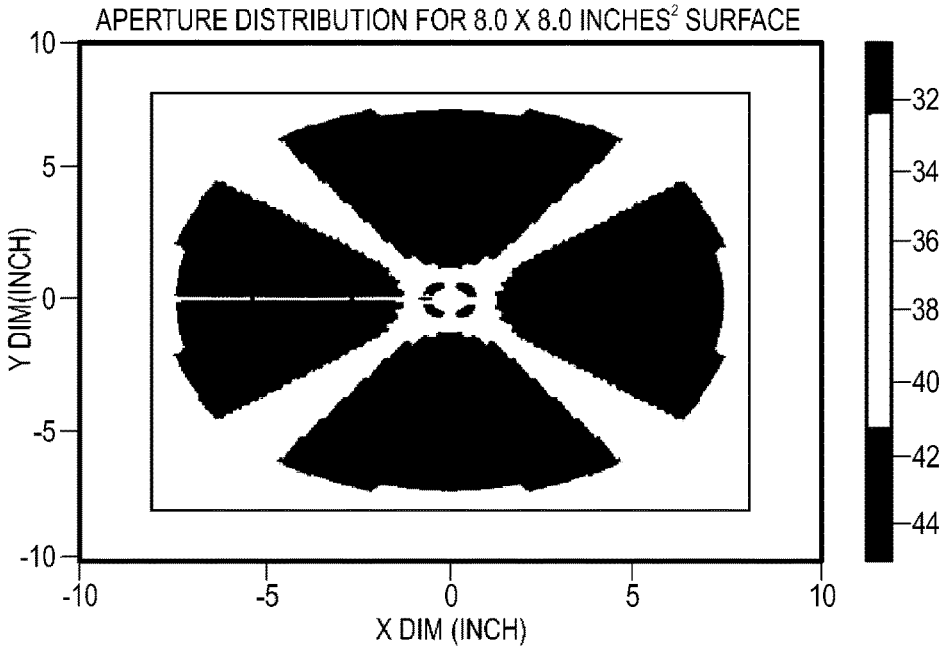

FIG. 4E illustrates an example of the square aperture that, for comparison purposes, shows a more uniform aperture distribution. The aperture distribution is more uniform as shown in FIG. 4E.

Figure 4F:
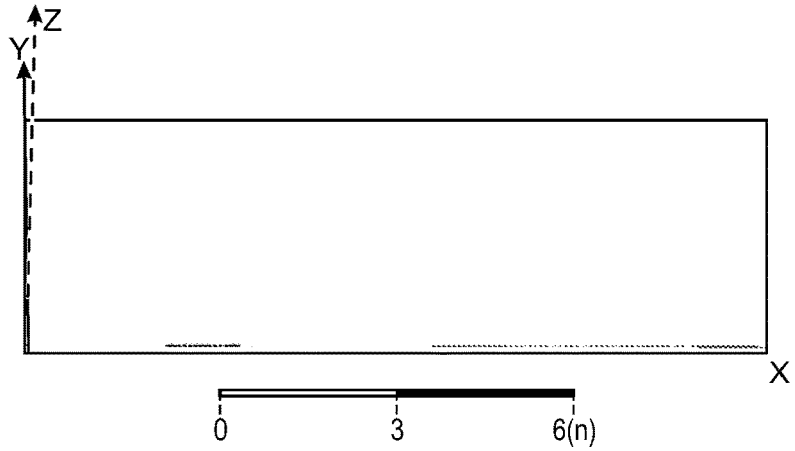
Figure 4G:
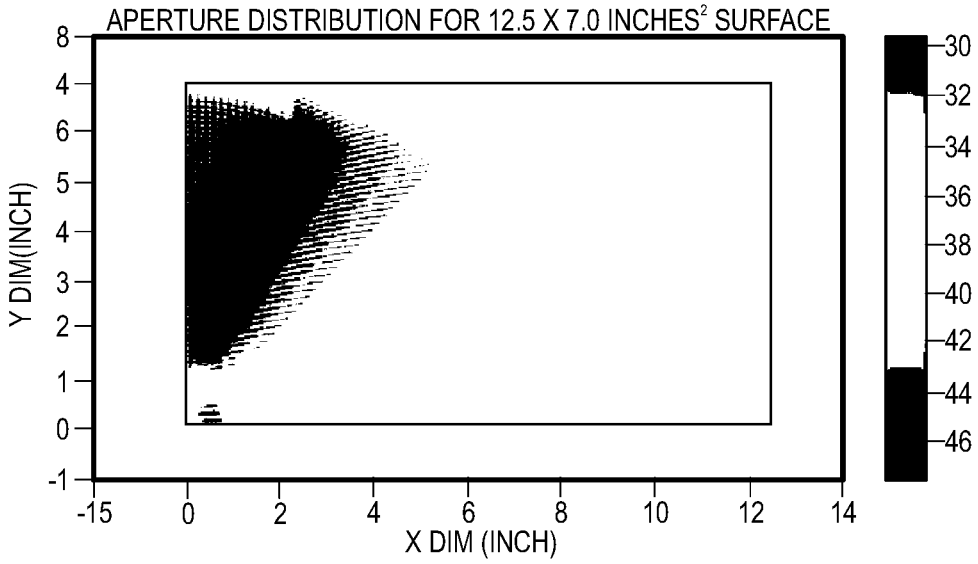
Figure 4H:
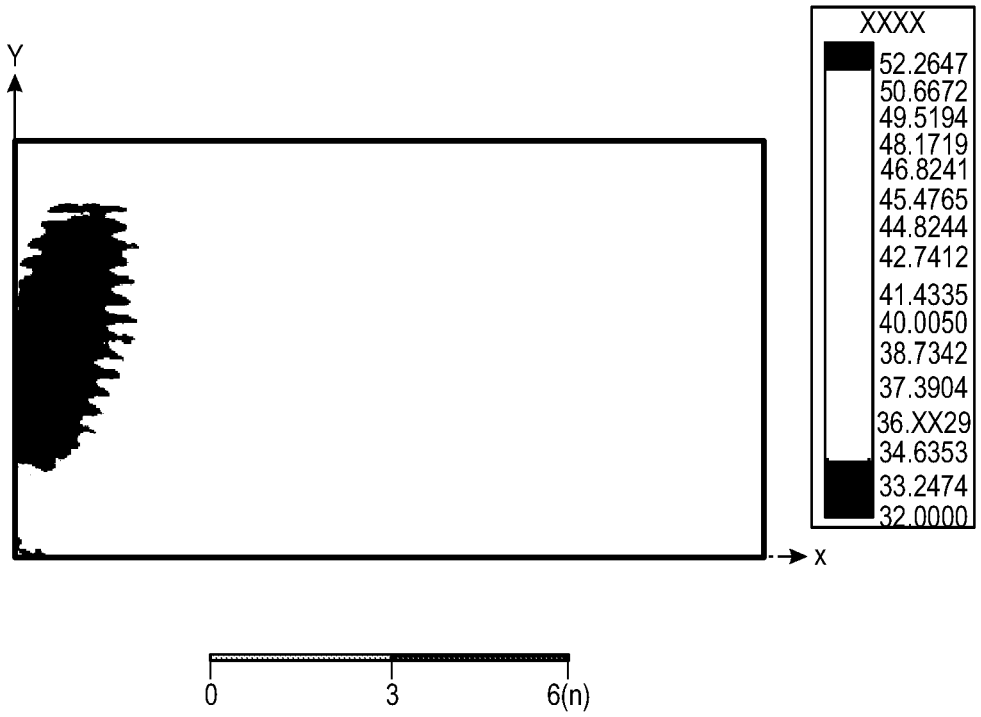
Figure 4I:
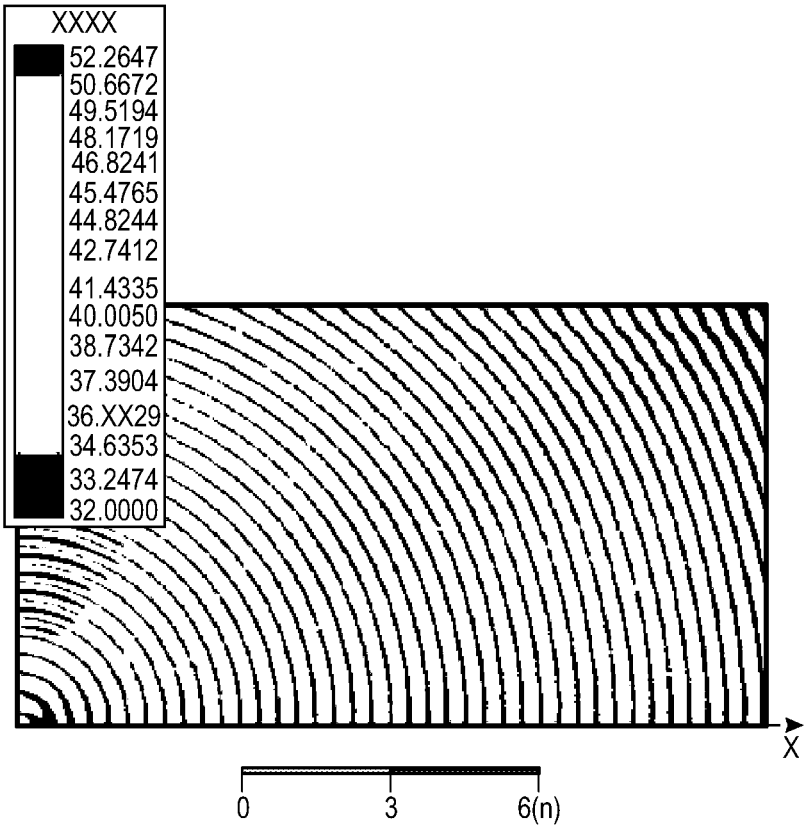

The coupler was built into an HFSS model and full-wave simulations were performed to measure both the power transferred to the antenna and the aperture distribution. The simulation time was reduced by simulating ¼ of the aperture using a sheet impedance to act as radiators on the surface of the top guide. FIG. 4F illustrates the HFSS model and the resulting simulation shows that the aperture distribution matched closely the analytic prediction and the power accepted was 90%. FIG. 4G illustrates an analytic ¼ aperture distribution prediction. FIG. 4H illustrates HFSS ¼ aperture distribution simulation result. FIG. 4I illustrates a HFSS ¼ aperture distribution simulation result showing radial mode preservation.

Figure 5:
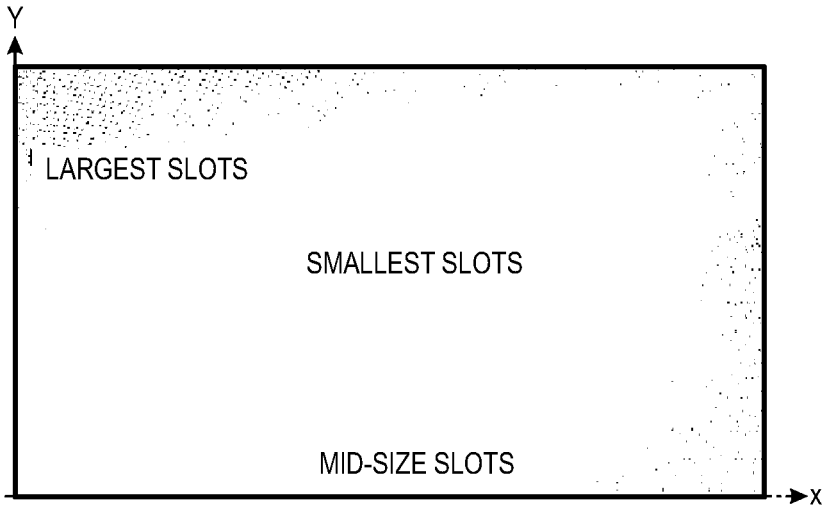
FIG. 5 illustrates a portion of an example directional coupler having different sized slots.

In one embodiment, the techniques disclosed herein for directional couplers use some of the same fundamental components as in some center-fed directional couplers with the only difference being that the directional coupler now contains features that are changing in a way that is not radially symmetric. FIG. 5 shows an example of this by inspecting the directional coupler slots used the ¼ aperture HFSS simulation.

Figure 6A:
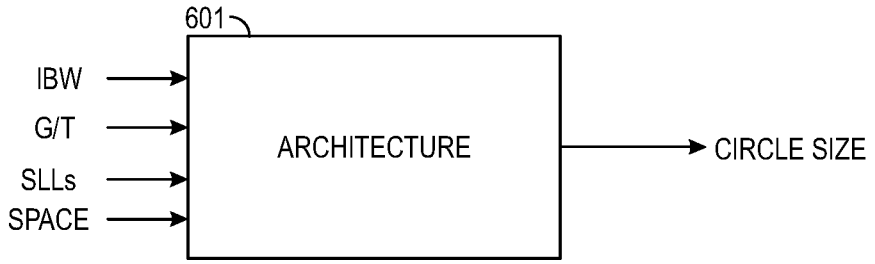
FIG. 6A illustrates a legacy design flow for an antenna aperture.
Figure 6B:
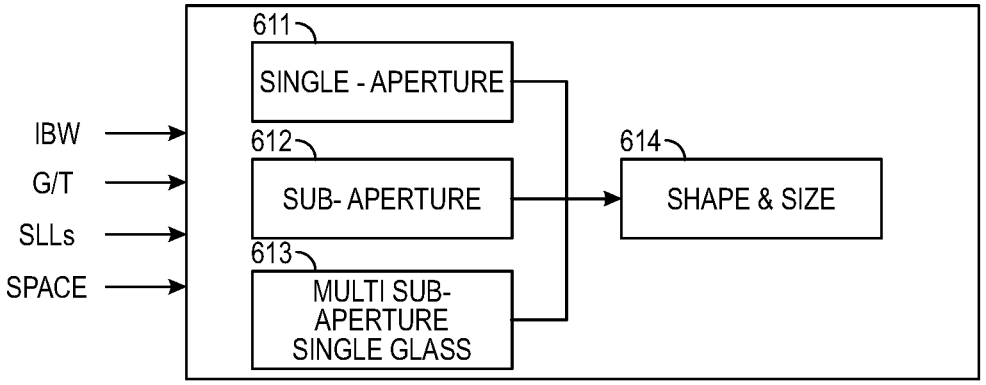
FIG. 6B illustrates one embodiment of a design flow for a non-circular aperture and tiling architecture.

The techniques disclosed herein open up a different way to approach design architecture. An example between legacy architecture design approach and new architecture design approach are shown in FIGS. 6A and 6B, respectively. Referring to FIG. 6A, the legacy design flow for creating an antenna aperture of circular shape based on one or more inputs is shown. The design constraints here are instantaneous bandwidth (IBW), gain to system noise temperature (G/T), system side lobe levels (SLLs), and the available space for the antennae aperture.

As shown in FIG. 6B, from non-circular apertures and tiling architecture design flow perspective, the same inputs are received and the resulting design may be a single aperture design 611, a sub-aperture design 612 with multiple sub-apertures, or a multi-sub-aperture 613 where the sub-apertures are part of a single substrate (single glass aperture) (as opposed to be separate individual antennas). Any of these designs can be the result of the design process in view of the inputs, ultimately determining the shape and size 614 of the aperture or apertures being developed.

Figure 6C:
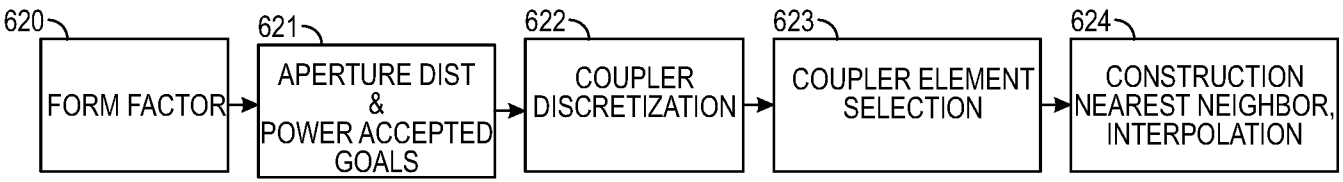
FIG. 6C illustrates a flow diagram of one embodiment of a process for designing an aperture.

FIG. 6C illustrates an example design flow. Referring to FIG. 6C, the area from the form factor 620 is used in conjunction with the goals 621 associated with aperture distribution and power accepted in view of the space associated with the form factor. These are used to create the number of discretized coupler designs 622. After discretization, a coupling element 623 is selected. In one embodiment, there are two common realizations of the element are both a slot and ring. Next, the directional coupler is constructed (624) with the coupling element along the entire surface using the discretized designs. In one embodiment, the construction is based on a nearest neighbor or interpolation as described above.

Examples of Antenna Embodiments

The techniques described above may be used with flat panel antennas. Embodiments of such flat panel antennas are disclosed. The flat panel antennas include one or more arrays of antenna elements on an antenna aperture. In one embodiment, the antenna elements comprise liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

Examples of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Antenna Elements

Figure 7A:
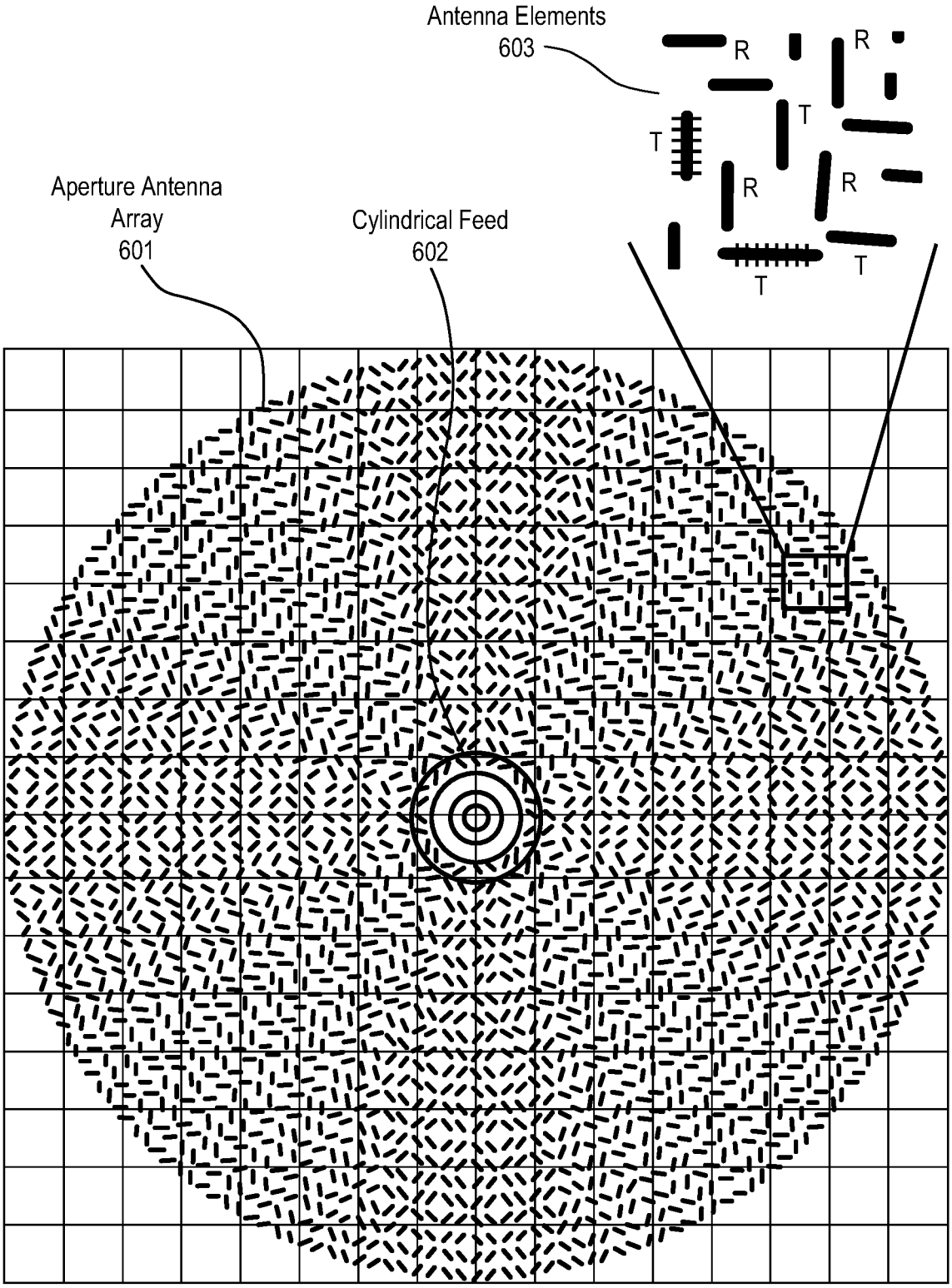
FIG. 7A illustrates the schematic of one embodiment of a cylindrically fed holographic radial aperture antenna.

FIG. 7A illustrates the schematic of one embodiment of a cylindrically fed holographic radial aperture antenna. Referring to FIG. 7A, the antenna aperture has one or more arrays 601 of antenna elements 603 that are placed in concentric rings around an input feed 602 of the cylindrically fed antenna. In one embodiment, antenna elements 603 are radio frequency (RF) resonators that radiate RF energy. In one embodiment, antenna elements 603 comprise both Rx and Tx irises that are interleaved and distributed on the whole surface of the antenna aperture. Examples of such antenna elements are described in greater detail below. Note that the RF resonators described herein may be used in antennas that do not include a cylindrical feed.

In one embodiment, the antenna includes a coaxial feed that is used to provide a cylindrical wave feed via input feed 602. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

In one embodiment, antenna elements 603 comprise irises and the aperture antenna of FIG. 7A is used to generate a main beam shaped by using excitation from a cylindrical feed wave for radiating irises through tunable liquid crystal (LC) material. In one embodiment, the antenna can be excited to radiate a horizontally or vertically polarized electric field at desired scan angles.

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. As would be understood by those skilled in the art, LC in the context of CELC refers to inductance-capacitance, as opposed to liquid crystal.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty-five-degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three-axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 7B:
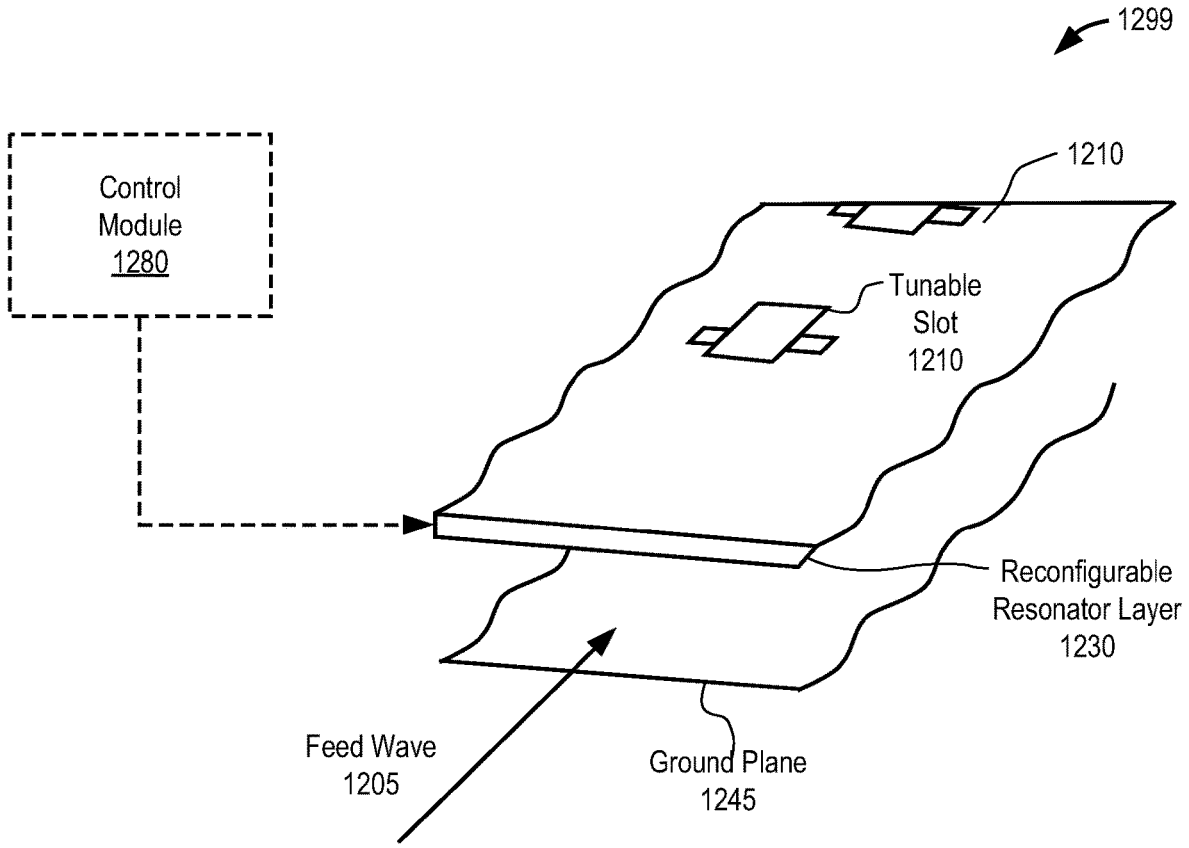
FIG. 7B illustrates a perspective view of one row of antenna elements that includes a ground plane and a reconfigurable resonator layer.

FIG. 7B illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Figure 8A:
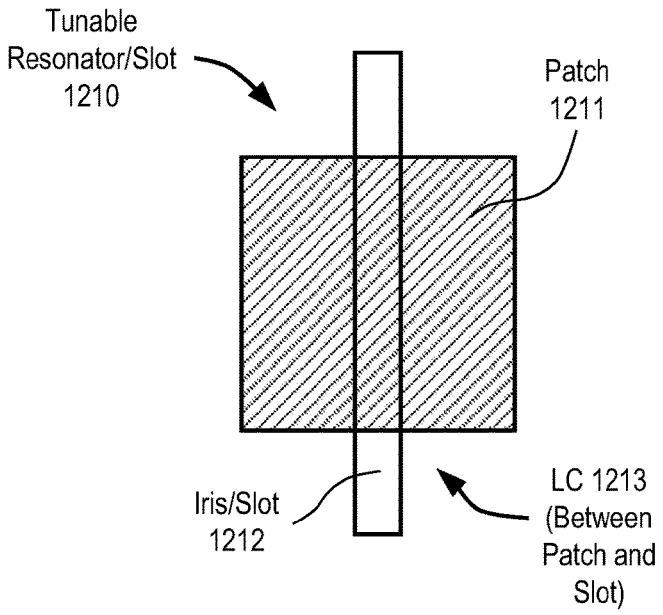
FIG. 8A illustrates one embodiment of a tunable resonator/slot.

Control module 1280 is coupled to reconfigurable resonator layer 1230 to modulate the array of tunable slots 1210 by varying the voltage across the liquid crystal in FIG. 8A. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w_{in}*w_{out}$, with $w_{in}$ as the wave equation in the waveguide and $w_{out}$ the wave equation on the outgoing wave.

FIG. 8A illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 8B:
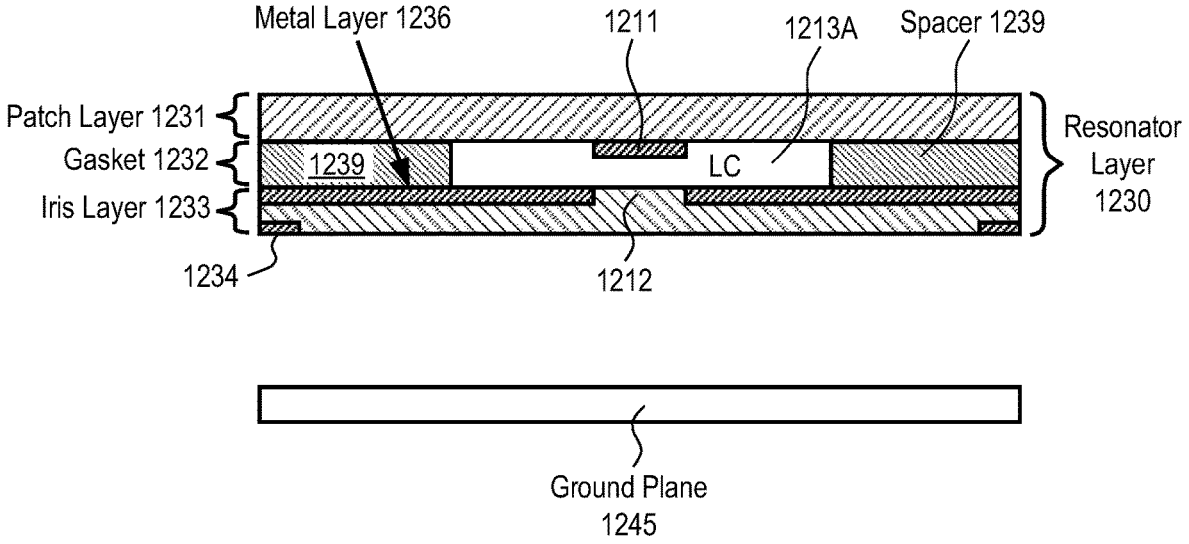
FIG. 8B illustrates a cross section view of one embodiment of a physical antenna aperture.

FIG. 8B illustrates a cross section view of one embodiment of a physical antenna aperture. The antenna aperture includes ground plane 1245, and a metal layer 1236 within iris layer 1233, which is included in reconfigurable resonator layer 1230. In one embodiment, the antenna aperture of FIG. 8B includes a plurality of tunable resonator/slots 1210 of FIG. 8A. Iris/slot 1212 is defined by openings in metal layer 1236. A feed wave, such as feed wave 1205 of FIG. 8A, may have a microwave frequency compatible with satellite communication channels. The feed wave propagates between ground plane 1245 and resonator layer 1230.

Reconfigurable resonator layer 1230 also includes gasket layer 1232 and patch layer 1231. Gasket layer 1232 is disposed between patch layer 1231 and iris layer 1233. Note that in one embodiment, a spacer could replace gasket layer 1232. In one embodiment, iris layer 1233 is a printed circuit board ("PCB") that includes a copper layer as metal layer 1236. In one embodiment, iris layer 1233 is glass. Iris layer 1233 may be other types of substrates.

Openings may be etched in the copper layer to form slots 1212. In one embodiment, iris layer 1233 is conductively coupled by a conductive bonding layer to another structure (e.g., a waveguide) in FIG. 8B. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1232 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 8B includes multiple tunable resonator/slots, such as tunable resonator/slot 1210 includes patch 1211, liquid crystal 1213, and iris 1212 of FIG. 8A. The chamber for liquid crystal 1213 is defined by spacers 1239, iris layer 1233 and metal layer 1236. When the chamber is filled with liquid crystal, patch layer 1231 can be laminated onto spacers 1239 to seal liquid crystal within resonator layer 1230.

A voltage between patch layer 1231 and iris layer 1233 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equation $f=1/2\pi\sqrt{LC}$ where f is the resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by $\lambda/5$. Other spacings may be used. In one embodiment, each tunable slot in a row is spaced from the closest tunable slot in an adjacent row by $\lambda/2$, and, thus, commonly oriented tunable slots in different rows are spaced by $\lambda/4$, though other spacings are possible (e.g., $\lambda/5$, $\lambda/6.3$). In another embodiment, each tunable slot in a row is spaced from the closest tunable slot in an adjacent row by $\lambda/3$.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 9A-D illustrate one embodiment of the different layers for creating the slotted array. The antenna array includes antenna elements that are positioned in rings, such as the example rings shown in FIG. 1A. Note that in this example the antenna array has two different types of antenna elements that are used for two different types of frequency bands.

Figure 9A:
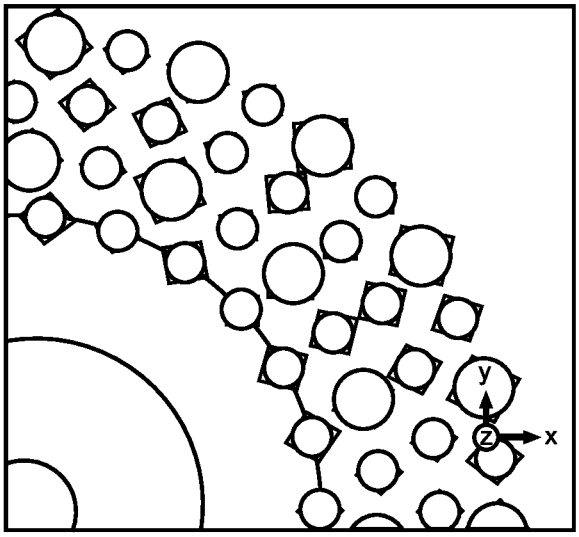
FIGS. 9A-D illustrate one embodiment of the different layers for creating the slotted array.
Figure 9B:
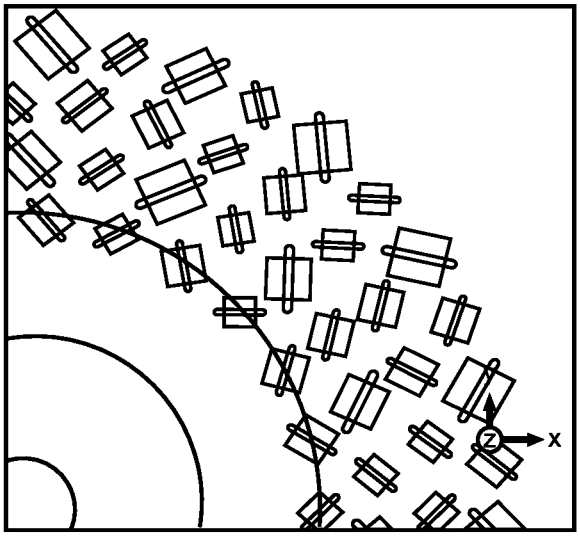
Figure 9C:
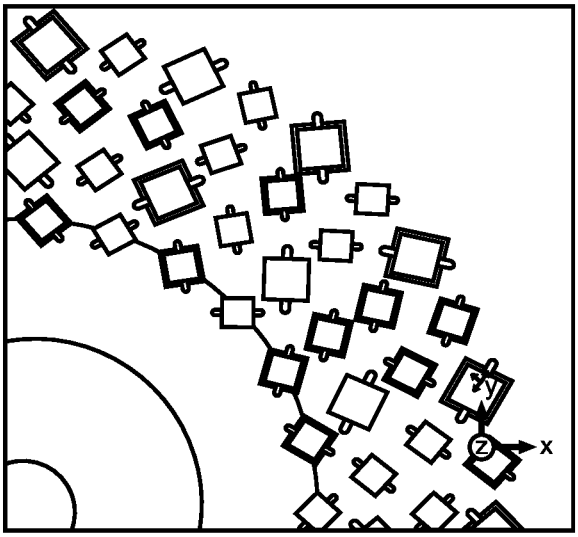
Figure 9D:
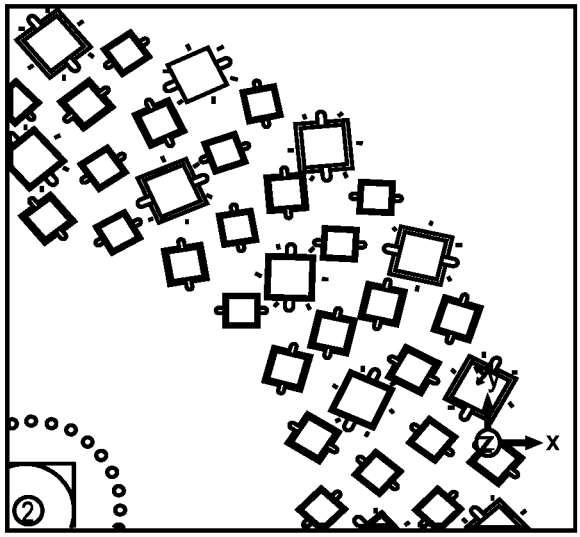

FIG. 9A illustrates a portion of the first iris board layer with locations corresponding to the slots. Referring to FIG. 9A, the circles are open areas/slots in the metallization in the bottom side of the iris substrate, and are for controlling the coupling of elements to the feed (the feed wave). Note that this layer is an optional layer and is not used in all designs. FIG. 9B illustrates a portion of the second iris board layer containing slots. FIG. 9C illustrates patches over a portion of the second iris board layer. FIG. 9D illustrates a top view of a portion of the slotted array.

Figure 10:
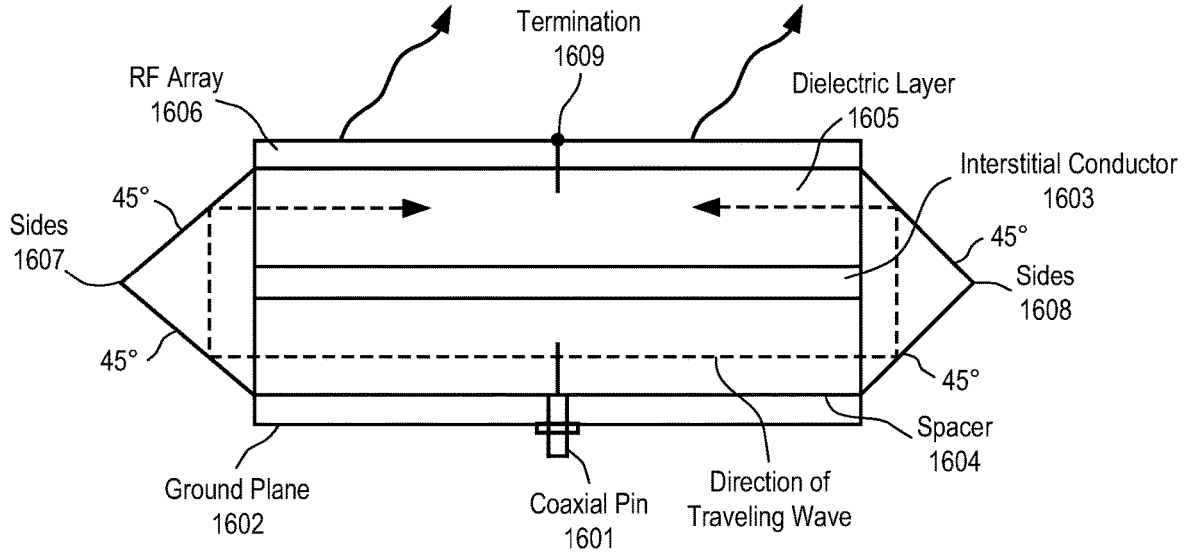
FIG. 10 illustrates a side view of one embodiment of a cylindrically fed antenna structure.

FIG. 10 illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 10 includes a coaxial feed, such as, for example, described in U.S. Publication No. 2015/0236412, entitled "Dynamic Polarization and Coupling Control from a Steerable Cylindrically Fed Holographic Antenna", filed on Nov. 21, 2014.

Referring to FIG. 10, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602.

Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 1603 is 0.1-0.15". In another embodiment, this distance may be λ/2, where λ is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 1606 is 0.1-0.15". In another embodiment, this distance may be $\lambda_{eff}/2$, where $\lambda_{eff}$ is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 10 shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 11:
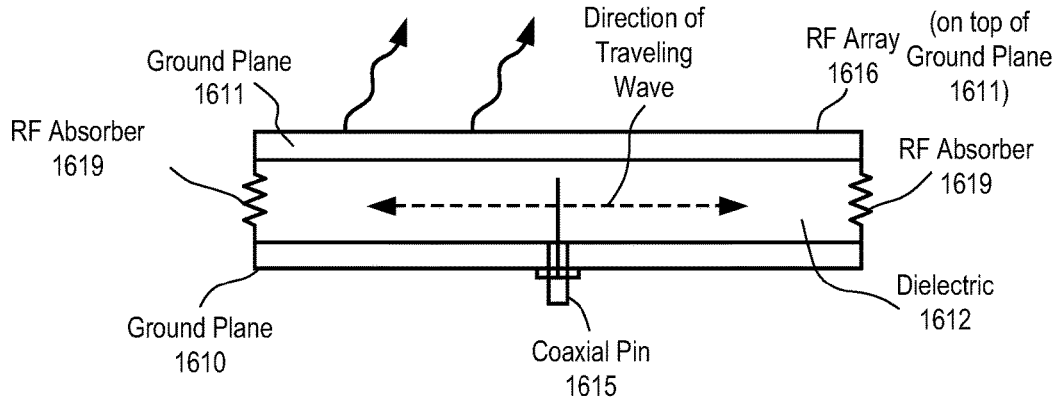
FIG. 11 illustrates another embodiment of the antenna system with an outgoing wave.

FIG. 11 illustrates another embodiment of the antenna system with an outgoing wave. Referring to FIG. 11, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 10 and 11 improves the service angle of the antenna. Instead of a service angle of plus or minus forty-five degrees azimuth (±45° Az) and plus or minus twenty-five degrees elevation (±25° El), in one embodiment, the antenna system has a service angle of seventy-five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 10 and RF array 1616 of FIG. 11 include a wave scattering subsystem that includes a group of patch antennas (e.g., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty-five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 12:
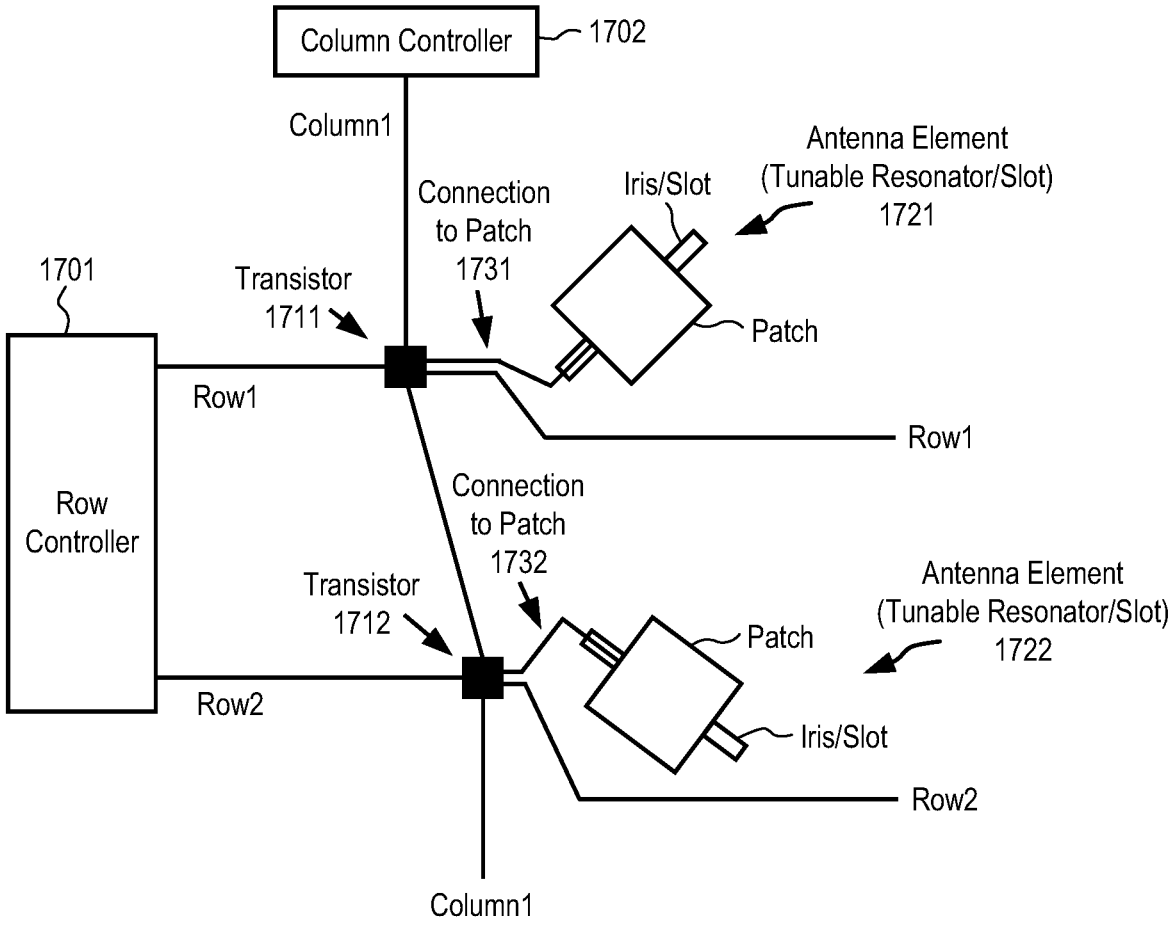
FIG. 12 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 12 illustrates one embodiment of the placement of matrix drive circuitry with respect to antenna elements. Referring to FIG. 12, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 13:
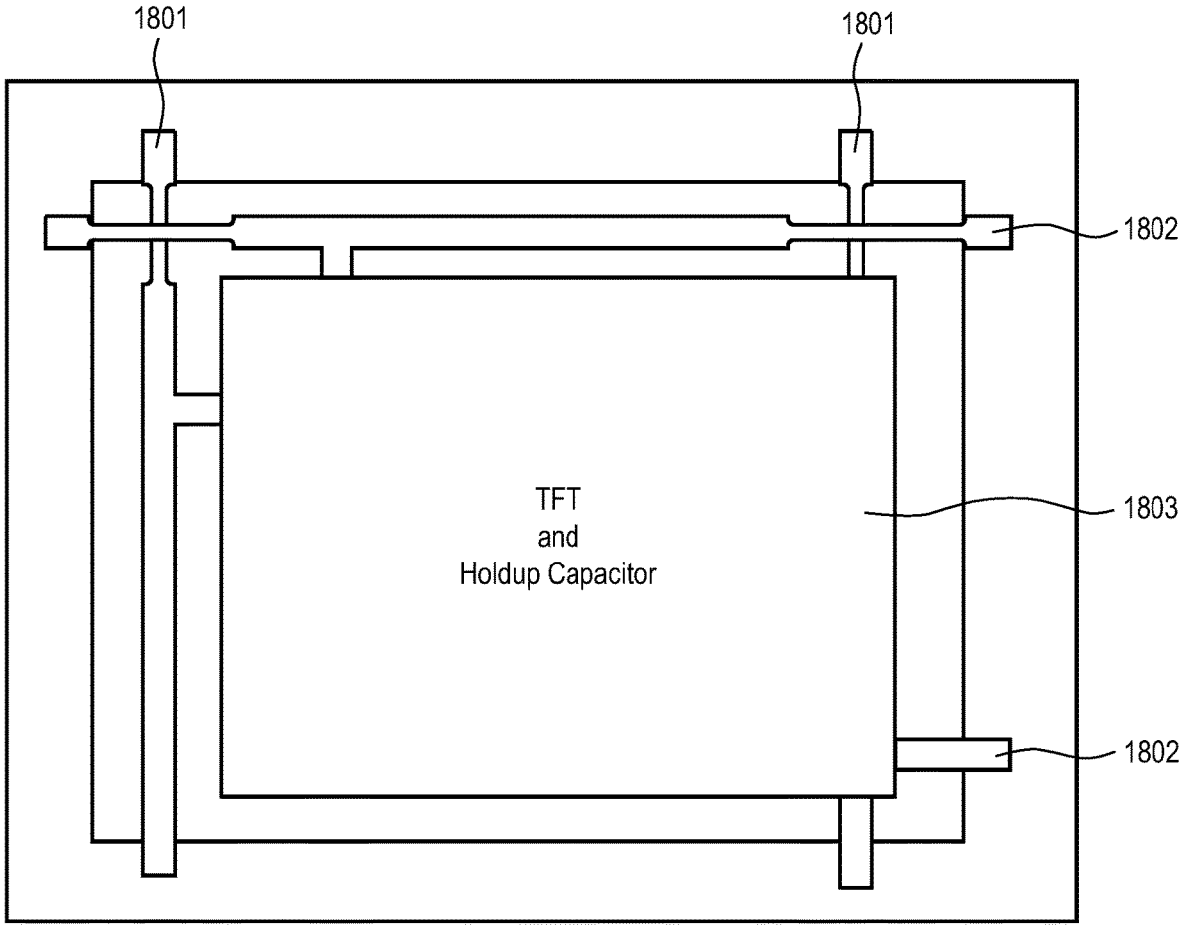
FIG. 13 illustrates one embodiment of a TFT package.

In one embodiment, a TFT package is used to enable placement and unique addressing in the matrix drive. FIG. 13 illustrates one embodiment of a TFT package. Referring to FIG. 13, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

An Example of a Full Duplex Communication System

Figure 14:
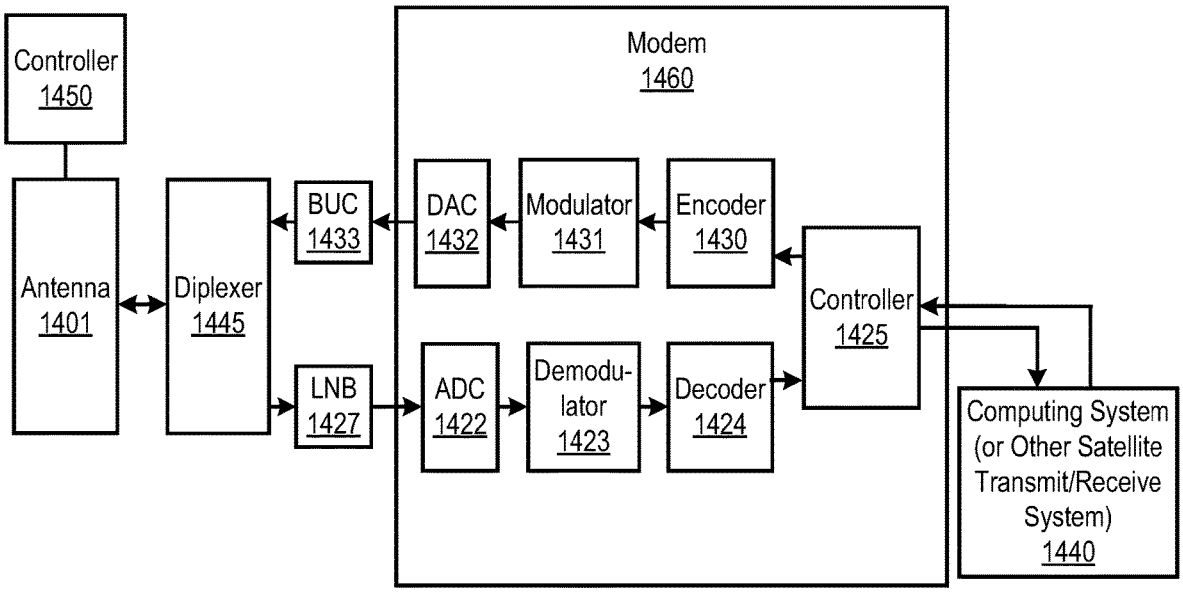
FIG. 14 is a block diagram of one embodiment of a communication system having simultaneous transmit and receive paths.

In another embodiment, the combined antenna apertures are used in a full duplex communication system. FIG. 14 is a block diagram of another embodiment of a communication system having simultaneous transmit and receive paths. While only one transmit path and one receive path are shown, the communication system may include more than one transmit path and/or more than one receive path.

Referring to FIG. 14, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (upconvert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

The communication system would be modified to include the combiner/arbiter described above. In such a case, the combiner/arbiter after the modem but before the BUC and LNB.

Note that the full duplex communication system shown in FIG. 14 has a number of applications, including but not limited to, internet communication, vehicle communication (including software updating), etc.

There is a number of example embodiments described herein.

Example 1 is an antenna comprising: a non-circular antenna aperture with radio-frequency (RF) radiating antenna elements; and a non-radially symmetric directional coupler to supply a RF feed wave to the aperture at a central location within the antenna aperture to enable the feed wave to propagate outward from the central location to an edge of the aperture.

Example 2 is the antenna of example 1 that may optionally include that the directional coupler is configured to have discrete sections of the antenna aperture with different coupling.

Example 3 is the antenna of example 1 that may optionally include that the directional coupler is configured to have different coupling based on radial lengths within the antenna aperture.

Example 4 is the antenna of example 1 that may optionally include that the directional coupler is configured to cause power to be radiated at different rates long different radial paths.

Example 5 is the antenna of example 1 that may optionally include that the antenna aperture comprises a metasurface and the RF radiating antenna elements are surface scattering metamaterial antenna elements.

Example 6 is the antenna of example 1 that may optionally include that a uniform aperture illumination is maintained without reflection at the edge of the aperture.

Example 7 is the antenna of example 1 that may optionally include that the antenna aperture has a rectangular, hexagon, octagon, or other non-radially-symmetric shape.

Example 8 is the antenna of example 1 that may optionally include that the antenna aperture comprises a holographic metasurface antenna aperture.

Example 9 is the antenna of example 1 that may optionally include that the RF radiating antenna elements are located radially with respect to the central location.

Example 10 is the antenna of example 9 that may optionally include that the RF radiating antenna elements are placed on rings or spirals, or portions thereof, with respect to the central location.

Example 11 is an antenna comprising: an antenna aperture having a plurality of non-circular sub-apertures tiling a space, where instantaneous bandwidth of the plurality of sub-apertures is greater than instantaneous bandwidth of a single aperture covering the space; and a plurality of non-radially symmetric directional couplers to supply RF feed waves to each of the plurality of sub-apertures at a central location within said each sub-aperture antenna aperture to enable the feed wave to propagate outward from the central location to an edge of the aperture.

Example 12 is the antenna of example 11 that may optionally include that the antenna aperture comprises a metasurface and the RF radiating antenna elements are surface scattering metamaterial antenna elements.

Example 13 is the antenna of example 11 that may optionally include that a uniform aperture illumination is maintained without reflection at the edge of the aperture.

Example 14 is the antenna of example 11 that may optionally include that the antenna aperture has a rectangular, hexagon, octagon, or other non-radially-symmetric shape.

Example 15 is the antenna of example 11 that may optionally include that the antenna aperture comprises a holographic metasurface antenna aperture.

Example 16 is the antenna of example 11 that may optionally include that the antenna aperture comprises the RF radiating antenna elements are located radially with respect to the central location.

Example 17 is the antenna of example 16 that may optionally include that the RF radiating antenna elements are placed on rings or spirals, or portions thereof, with respect to the central location.

Example 18 is the antenna of example 11 that may optionally include that the aperture comprises a plurality of substrates comprising slots and patches in patch/slot pairs, wherein one or more of the plurality of substrates are part of two or more sub-apertures of the plurality of sub-apertures.

Example 19 is the antenna of example 11 that may optionally include that each of the plurality of substrates comprises a glass layer.

Example 20 is an antenna comprising: a non-circular antenna aperture comprising a metasurface with radio-frequency (RF) radiating antenna elements comprising surface scattering metamaterial antenna elements; and a non-radially symmetric directional coupler to supply a RF feed wave to the aperture at a central location within the antenna aperture to enable the feed wave to propagate outward from the central location to an edge of the aperture, wherein the directional coupler is configured to have discrete sections of the antenna aperture with different coupling.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An antenna comprising:

a tiled antenna aperture with a plurality of separate non-circular antenna apertures having a plurality of radio-frequency (RF) radiating antenna elements;

a plurality of wave propagating structures;

a plurality of input feeds to feed RF feed waves into the plurality of wave propagating structures; and a plurality of non-radially symmetric directional couplers, each of the plurality of non-radially symmetric directional couplers being within one of the plurality of wave propagating structures and for coupling power of one RF feed wave of the RF feed waves to one of the plurality of non-circular antenna apertures at a central location within said each sub-aperture antenna aperture to enable the feed wave to propagate outward from the central location to an edge of the aperture.

2. The antenna of claim 1 where instantaneous bandwidth of the plurality of non-circular antenna apertures is greater than instantaneous bandwidth of a single aperture covering the space.

3. The antenna of claim 1 wherein said each non-radially symmetric directional coupler is configured to couple power of the one RF feed wave to the one non-circular antenna aperture at a central location within said each non-circular antenna aperture to enable the feed wave to propagate outward from the central location to an edge of the aperture.

4. The antenna of claim 3 wherein a uniform aperture illumination with RF feed waves is maintained without reflection at the edge of the aperture.

5. The antenna of claim 1 wherein the antenna aperture comprises a plurality of metasurfaces and the RF radiating antenna elements are surface scattering metamaterial antenna elements.

6. The antenna of claim 1 wherein the antenna aperture has a rectangular, hexagon, octagon, or other non-radially-symmetric shape.

7. The antenna of claim 1 wherein the antenna aperture comprises a plurality of metasurfaces having surface scattering metamaterial antenna elements.

8. The antenna of claim 1 wherein the antenna aperture comprises a holographic metasurface antenna aperture.

9. The antenna of claim 1 wherein the RF radiating antenna elements are located radially with respect to the central location.

10. The antenna of claim 9 wherein the RF radiating antenna elements are placed on rings or spirals, or portions thereof, with respect to the central location.

11. The antenna of claim 1 wherein the aperture comprises a plurality of substrates comprising slots and patches in patch/slot pairs, wherein one or more of the plurality of substrates are part of two or more sub-apertures of the plurality of sub-apertures.

12. The antenna of claim 11 wherein each of the plurality of substrates comprises a glass layer.

13. An antenna comprising:

a plurality of non-circular antenna apertures with radio-frequency (RF) radiating antenna elements;

a plurality of wave propagating structures coupled the plurality of non-circular antenna apertures to propagate RF feed waves to the plurality of non-circular antenna apertures, at least one wave propagating structures of the plurality of wave propagating structures having:

a top waveguide, a bottom waveguide coupled to receive the RF feed wave from the feed, a non-radially symmetric directional coupler for coupling power of the RF feed wave from the bottom waveguide to the top waveguide to feed one of the non-circular antenna apertures to enable the feed wave to propagate outward from the feed within the aperture.

14. The antenna of claim 13 wherein the non-radially symmetric directional coupler is configured to have discrete sections of the antenna aperture with different coupling.

15. The antenna of claim 13 wherein the non-radially symmetric directional coupler is configured to have different coupling of the power of the RF feed wave based on radial lengths within the antenna aperture.

16. The antenna of claim 13 wherein the non-radially symmetric directional coupler is configured to cause power to be radiated at different rates long different radial paths.

17. The antenna of claim 13 wherein each of the plurality of non-circular antenna apertures comprises a metasurface and the RF radiating antenna elements are surface scattering metamaterial antenna elements.

18. The antenna of claim 13 wherein a uniform aperture illumination with the RF feed wave is maintained without reflection at the edge of the aperture.

19. The antenna of claim 13 wherein the plurality of non-circular antenna apertures comprises a holographic metasurface antenna aperture.

20. The antenna of claim 13 wherein the non-radially symmetric directional coupler is configured to couple power of the RF feed wave as the RF feed wave propagates outwardly from a central location within the at least one wave propagating structure, wherein the directional coupler is configured to have discrete sections of the antenna aperture with different coupling.

* * * * *